US009599414B2

(12) United States Patent
Yin et al.

(10) Patent No.: US 9,599,414 B2
(45) Date of Patent: Mar. 21, 2017

(54) LIQUID RESERVOIR

(75) Inventors: Bin Yin, Zhejiang (CN); Lixin Wang, Hangzhou Zhejiang (CN); Zhengwei Wang, Zhejiang (CN)

(73) Assignee: ZHEJIANG SANHUA AUTOMOTIVE COMPONENTS CO., LTD, Hangzhou, Zhejiang (CN)

( * ) Notice: Subject to any disclaimer, the term of this patent is extended or adjusted under 35 U.S.C. 154(b) by 672 days.

(21) Appl. No.: 13/814,543

(22) PCT Filed: Nov. 17, 2011

(86) PCT No.: PCT/CN2011/082334
§ 371 (c)(1),
(2), (4) Date: Feb. 6, 2013

(87) PCT Pub. No.: WO2012/065558
PCT Pub. Date: May 24, 2012

(65) Prior Publication Data

US 2013/0220583 A1 Aug. 29, 2013

(30) Foreign Application Priority Data

Nov. 17, 2010 (CN) ..... 2010 2 0611886 U

(51) Int. Cl.
*F28F 19/01* (2006.01)
*F25B 43/00* (2006.01)
(Continued)

(52) U.S. Cl.
CPC ..... *F28F 19/01* (2013.01); *B21D 53/02* (2013.01); *F25B 43/00* (2013.01); *F28F 9/0253* (2013.01);
(Continued)

(58) Field of Classification Search
CPC F25B 39/04; F25B 43/003; F25B 2339/0441; F25B 2339/0446; F25B 43/00;
(Continued)

(56) References Cited

U.S. PATENT DOCUMENTS 2,148,770 A * 2/1939 Mittendorf ..... F25B 43/003 210/266
2,873,856 A * 2/1959 Jones ..... F25B 43/003 210/266
(Continued)

FOREIGN PATENT DOCUMENTS

CA 2391375 A1 6/2001
CN 2048946 U 12/1989
(Continued)

OTHER PUBLICATIONS

International Search Report dated Mar. 1, 2012 from corresponding International Patent Application No. PCT/CN2011/082334, 5 pages with English translation.

*Primary Examiner* — Tho V Duong
(74) *Attorney, Agent, or Firm* — Ohlandt, Greeley, Ruggiero & Perle, LLP

(57) ABSTRACT

A liquid reservoir used in a heat exchanger, for example an automotive air conditioner, and a manufacturing method therefor. The liquid reservoir includes an inlet hole and an outlet hole. The outlet hole is provided with a filter element covering the outlet hole. A flow area at a location of the outlet hole covered by the filter element is greater than the cross-sectional area of other locations of the outlet hole. In this way, in the case that other structures of the inlet hole are not improved, a filtering area of the filter element is increased, thereby increasing a flow area of a refrigerant, reducing a flow resistance effect exerted by the filter element on the refrigerant, and reducing a workload of the heat exchanger.

15 Claims, 7 Drawing Sheets

(51) Int. Cl.
*F28F 9/02* (2006.01)
*B21D 53/02* (2006.01)

(52) U.S. Cl.
CPC ..... *F25B 2339/044* (2013.01); *F25B 2400/16* (2013.01); *Y10T 29/4935* (2015.01)

(58) Field of Classification Search
CPC ..... F25B 2339/044; F25B 2400/16; B21D 53/02; F28F 9/0253; F28F 19/01; Y10T 29/4935
USPC ..... 62/474, 509
See application file for complete search history.

(56) References Cited

U.S. PATENT DOCUMENTS

| | | | | |
|---|---|---|---|---|
| 4,026,685 | A * | 5/1977 | Grix | B01D 46/30 137/204 |
| 4,072,615 | A | 2/1978 | McConnell | |
| 5,289,697 | A | 3/1994 | Hutchison | |
| 5,425,250 | A | 6/1995 | Hutchison et al. | |
| 5,435,153 | A | 7/1995 | Hutchison et al. | |
| 5,515,696 | A | 5/1996 | Hutchison | |
| 5,557,945 | A * | 9/1996 | Mangyo | F25B 43/003 210/DIG. 6 |
| 5,611,215 | A | 3/1997 | Saito et al. | |
| 5,774,982 | A | 7/1998 | Hutchison et al. | |
| 5,865,998 | A | 2/1999 | Abraham et al. | |
| 5,910,165 | A | 6/1999 | Haramoto et al. | |
| 6,330,810 | B1 | 12/2001 | Yamazaki et al. | |
| 6,622,517 | B1 | 9/2003 | Whitlow et al. | |
| 7,465,314 | B2 | 12/2008 | Kiblawi | |
| 2001/0032478 | A1 | 10/2001 | McAllister et al. | |
| 2003/0121278 | A1 | 7/2003 | Ichimura et al. | |
| 2004/0007012 | A1 | 1/2004 | Lee et al. | |
| 2005/0115270 | A1 | 6/2005 | Furuta et al. | |
| 2005/0279125 | A1 | 12/2005 | Operschall | |
| 2006/0060327 | A1 | 3/2006 | Yu et al. | |
| 2006/0065123 | A1 | 3/2006 | Evans | |
| 2006/0070724 | A1 | 4/2006 | Yu et al. | |
| 2008/0314252 | A1 | 12/2008 | Min et al. | |
| 2012/0217198 | A1 | 8/2012 | Chen et al. | |

FOREIGN PATENT DOCUMENTS

| | | | | |
|---|---|---|---|---|
| CN | 2278185 | Y | 4/1998 | |
| CN | 2285677 | Y | 7/1998 | |
| CN | 2285727 | Y | 7/1998 | |
| CN | 2310271 | Y | 3/1999 | |
| CN | 2316162 | Y | 4/1999 | |
| CN | 2436895 | Y | 6/2001 | |
| CN | 2563482 | Y | 7/2003 | |
| CN | 2578136 | Y | 10/2003 | |
| CN | 1477352 | A | 2/2004 | |
| CN | 1504708 | A | 6/2004 | |
| CN | 2624132 | Y | 7/2004 | |
| CN | 2630756 | Y | 8/2004 | |
| CN | 2637998 | Y | 9/2004 | |
| CN | 2695881 | Y | 4/2005 | |
| CN | 2767923 | Y | 3/2006 | |
| CN | 2767924 | Y | 3/2006 | |
| CN | 2837746 | Y | 11/2006 | |
| CN | 1877229 | A | 12/2006 | |
| CN | 2847180 | Y | 12/2006 | |
| CN | 1888745 | A | 1/2007 | |
| CN | 1924489 | A | 3/2007 | |
| CN | 2911557 | Y | 6/2007 | |
| CN | 1995876 | A | 7/2007 | |
| CN | 101002061 | A | 7/2007 | |
| CN | 2929598 | Y | 8/2007 | |
| CN | 200965377 | Y | 10/2007 | |
| CN | 101074810 | A | 11/2007 | |
| CN | 200986352 | Y | 12/2007 | |
| CN | 201007587 | Y | 1/2008 | |
| CN | 201028903 | Y | 2/2008 | |
| CN | 201074932 | Y | 6/2008 | |
| CN | 201074933 | Y | 6/2008 | |
| CN | 101311648 | A | 11/2008 | |
| CN | 201173649 | Y | 12/2008 | |
| CN | 201203307 | Y | 3/2009 | |
| CN | 201203311 | Y | 3/2009 | |
| CN | 201233139 | Y | 5/2009 | |
| CN | 201233141 | Y | 5/2009 | |
| CN | 201233142 | Y | 5/2009 | |
| CN | 201237408 | Y | 5/2009 | |
| CN | 101487648 | A | 7/2009 | |
| CN | 101545703 | A | 9/2009 | |
| CN | 101545704 | A | 9/2009 | |
| CN | 101586897 | A | 11/2009 | |
| CN | 201387190 | Y | 1/2010 | |
| CN | 201392060 | Y | 1/2010 | |
| CN | 201397000 | Y | 2/2010 | |
| CN | 101666568 | A | 3/2010 | |
| CN | 101672556 | A | 3/2010 | |
| CN | 201488414 | U | 5/2010 | |
| CN | 101769661 | A | 7/2010 | |
| CN | 101839594 | A | 9/2010 | |
| CN | 101839595 | A | 9/2010 | |
| CN | 101852669 | A | 10/2010 | |
| CN | 101893358 | A | 11/2010 | |
| CN | 201688950 | U | 12/2010 | |
| CN | 201852383 | | 6/2011 | |
| CN | 102141329 | A | 8/2011 | |
| CN | 201945105 | U | 8/2011 | |
| CN | 102175067 | A | 9/2011 | |
| CN | 201983544 | U | 9/2011 | |
| CN | 102287977 | A | 12/2011 | |
| CN | 102305503 | A | 1/2012 | |
| CN | 202105537 | U | 1/2012 | |
| CN | 202109706 | U | 1/2012 | |
| CN | 102338515 | A | 2/2012 | |
| CN | 102353191 | A | 2/2012 | |
| CN | 202133201 | U | 2/2012 | |
| CN | 102419294 | A | 4/2012 | |
| CN | 102435526 | A | 5/2012 | |
| CN | 102445034 | A | 5/2012 | |
| CN | 202240177 | U | 5/2012 | |
| CN | 202254539 | U | 5/2012 | |
| CN | 202274684 | U | 6/2012 | |
| CN | 102538323 | A | 7/2012 | |
| CN | 102589212 | A | 7/2012 | |
| CN | 202328958 | U | 7/2012 | |
| CN | 102650481 | A | 8/2012 | |
| CN | 102650482 | A | 8/2012 | |
| CN | 202403469 | U | 8/2012 | |
| CN | 102679643 | A | 9/2012 | |
| CN | 202432775 | U | 9/2012 | |
| CN | 202442556 | U | 9/2012 | |
| CN | 102706049 | A | 10/2012 | |
| CN | 102721242 | A | 10/2012 | |
| CN | 102743915 | A | 10/2012 | |
| CN | 202470555 | U | 10/2012 | |
| CN | 202598968 | U | 12/2012 | |
| CN | 202605838 | U | 12/2012 | |
| CZ | EP 2110623 | A1 * | 10/2009 | F25B 39/04 |
| EP | 0666456 | A1 | 8/1995 | |
| EP | 0696714 | A1 | 2/1996 | |
| EP | 0921022 | A2 | 6/1999 | |
| EP | 1353134 | A1 | 10/2003 | |
| EP | 1363088 | A1 | 11/2003 | |
| EP | 1387134 | A2 | 2/2004 | |
| EP | 1764569 | A1 | 3/2007 | |
| JP | 06201232 | A | 7/1994 | |
| JP | H07269993 | A | 10/1995 | |
| JP | H08169227 | A | 7/1996 | |
| JP | H09273836 | A | 10/1997 | |
| JP | 2002090006 | A | 3/2002 | |
| JP | 2004309127 | A | 11/2004 | |
| JP | EP 1586834 | A1 * | 10/2005 | F25B 39/04 |
| JP | 2006052938 | A | 2/2006 | |
| JP | 2007218441 | A | 8/2007 | |
| KR | 20010058434 | A | 7/2001 | |
| KR | 20010084509 | A | 9/2001 | |
| KR | 20020037084 | A | 5/2002 | |

(56) References Cited

FOREIGN PATENT DOCUMENTS

| | | | |
|---|---|---|---|
| KR | 20020078060 | A | 10/2002 |
| KR | 20020079084 | A | 10/2002 |
| KR | 20020087175 | A | 11/2002 |
| KR | 20030030501 | A | 4/2003 |
| KR | 20030045273 | A | 6/2003 |
| KR | 20030048910 | A | 6/2003 |
| KR | 20030051158 | A | 6/2003 |
| KR | 20030054364 | A | 7/2003 |
| KR | 20030065614 | A | 8/2003 |
| KR | 20030075988 | A | 9/2003 |
| KR | 20030085221 | A | 11/2003 |
| KR | 20040005239 | A | 1/2004 |
| KR | 20040005241 | A | 1/2004 |
| KR | 20040057358 | A | 7/2004 |
| KR | 20040060061 | A | 7/2004 |
| KR | 20040060069 | A | 7/2004 |
| KR | 20040061531 | A | 7/2004 |
| KR | 20040061532 | A | 7/2004 |
| KR | 20040061629 | A | 7/2004 |
| KR | 20040068393 | A | 7/2004 |
| KR | 20040081661 | A | 9/2004 |
| KR | 20040102686 | A | 12/2004 |
| KR | 20050001841 | A | 1/2005 |
| KR | 20050005810 | A | 1/2005 |
| KR | 20050015761 | A | 2/2005 |
| KR | 100692996 | B1 | 3/2007 |
| KR | 20070025712 | A | 3/2007 |
| KR | 20070081324 | A | 8/2007 |
| KR | 100765919 | B1 | 10/2007 |
| KR | 20080004857 | A | 1/2008 |
| KR | 20080076226 | A | 8/2008 |
| KR | 20080077529 | A | 8/2008 |
| KR | 100855707 | B1 | 9/2008 |
| KR | 20080098243 | A | 11/2008 |
| KR | 20080100924 | A | 11/2008 |
| KR | 20080100926 | A | 11/2008 |
| KR | 20090041111 | A | 4/2009 |
| KR | 20090080311 | A | 7/2009 |
| KR | 20090080312 | A | 7/2009 |
| KR | 20090080313 | A | 7/2009 |
| KR | 20090096007 | A | 9/2009 |
| KR | 20090106826 | A | 10/2009 |
| KR | 20090118448 | A | 11/2009 |
| KR | 20090118527 | A | 11/2009 |
| KR | 20100025185 | A | 3/2010 |
| KR | 20100081089 | A | 7/2010 |
| KR | 101045047 | B1 | 6/2011 |
| KR | 101045048 | B1 | 6/2011 |
| KR | 20110088694 | A | 8/2011 |
| WO | 9733129 | A1 | 9/1997 |
| WO | 9804875 | A1 | 2/1998 |
| WO | 0159373 | A1 | 8/2001 |
| WO | 2006016761 | A1 | 2/2006 |

* cited by examiner

LIQUID RESERVOIR

This application is the national phase of International Application No. PCT/CN2011/082334, entitled "Liquid Reservoir and Manufacturing Method Therefor", filed on Nov. 17, 2011, which claims the benefit of priority to Chinese Patent Application No. 201020611886.0 titled "HEAT EXCHANGER AND RECEIVER THEREOF", filed with the Chinese State Intellectual Property Office on Nov. 17, 2010, the entire disclosure of which is incorporated herein by reference.

FIELD OF THE INVENTION

The present application relates to the field of heat exchange apparatus, and particularly to a liquid reservoir for a heat exchanger such as an automobile air conditioner. The liquid reservoir is also known as a receiver to those of ordinary skill in the art. The present application further relates to a method for manufacturing the receiver.

BACKGROUND OF THE INVENTION

With the rapid development of Chinese economy and construction, various heat exchangers are more and more widely used in every field of production and living.

In the heat exchangers such as an automobile air conditioner, the receiver used as a container for storing the liquid refrigerant is an indispensable component of the heat exchanger. The main functions of the receiver are to store the refrigerant, filter the impurity and absorb the moisture. Taking the automobile air conditioner for example, the main structural types of the receiver may include a sight glass base type, a head type, an upper/lower receiver body type and a supercooling type structure type. At present, the upper/lower receiver body type receiver is more and more widely used by automobile air conditioner manufactures at home and abroad.

Reference is made to FIG. 1 which is a partial structural schematic view of a typical receiver.

The typical receiver belongs to the upper/lower receiver body type receiver, which has an elongated contour and is formed by welding a first receiver body assembly and a second receiver body assembly after the two assemblies are assembled. The first receiver body assembly includes a first receiver body 11 provided with an inlet hole 111 and an outlet hole 112. The outlet hole 112 is a single through hole and an outer diameter of an outer end thereof is constant. The outlet hole 112 is cooperated, via the outer wall thereof, with other elements. The inner end of the outlet hole 112 of the first receiver body 11 is provided with a metal filter screen 13 and a filter 14. A retaining plate 15 is mounted on the metal filter screen 13 by spot welding generally. After the metal filter screen 13 and the retaining plate 15 are mounted to the first receiver body 11, inwardly protruded dots 16 are provided on the first receiver body 11 by dotting to thereby limit the retaining plate 15 via the inwardly protruded dots 16. In the operating process, the refrigerant flows, from the inlet hole 111 of the first receiver body 11, into the receiver after being filtered by the metal filter screen 13, and then flows out of the receiver after being filtered by the filter 14 and the metal filter screen 13.

One of the main functions of the receiver for an automobile air conditioner is to filter the impurity, for example, the impurity having a size larger than 60 micrometers. Therefore, the filter generally employs a material of non-woven fabric. In order that the non-woven fabric filter has sufficient filter capacity, the non-woven fabric filter should have a high density. However, the higher the density is, the larger the flow resistance of the hole suffers. The filter is mounted at the inner end of the outlet hole, therefore the effective flow area of the filter is the portion corresponding to the outlet hole. The load of the air conditioner system becomes higher in cases that the flow resistance of the filter to the refrigerant is high. Where being compressed, the density of the non-woven fabric or other filter elements is increased and the porosity is decreased, therefore the filter precision is increased, however, the flow resistance is accordingly increased. The high pressure end of the automobile air conditioner system has no sufficient supercooling degree since the flow resistance is large, more refrigerant is needed to achieve the same cooling effect. If the flow resistance is too large, the load of the compressor will be increased and the compressor may even be damaged.

Therefore, there is an urgent demand for those skilled in the art to ensure the filter precision as well as to reduce the flow resistance of the filter to the refrigerant, and to reduce the workload of the heat exchanger.

SUMMARY OF THE INVENTION

An object of the present application is to provide a receiver for a heat exchanger such as an automobile air conditioner, to reduce the flow resistance of the filter element of the receiver to the refrigerant without changing the contour structure of the receiver, thereby reducing the workload of the heat exchanger. Another object of the present application is to provide a method for manufacturing the receiver.

In order to solve the above technical problems, it is provided according to the present application a receiver for a heat exchanger. The receiver includes an inlet hole and an outlet hole. The outlet hole is mounted with a filter element which covers the outlet hole. A flow area of the outlet hole at a position of the outlet hole covered with the filter element is larger than cross-sectional areas of the outlet hole at other positions thereof. Thereby, a flow resistance of the filter element against a refrigerant is reduced.

Preferably, the outlet hole includes a main body portion and a counter bore portion. The filter element is mounted at the counter bore portion, and a surface area of the counter bore portion at a position of the counter bore portion covered with the filter element is larger than a cross-sectional area of the main body portion.

Optionally, a surface of the counter bore portion covered with the filter element includes a first arc segment and a second arc segment connected in a closed-loop manner.

Optionally, the surface of the counter bore portion covered with the filter element has a circular shape.

Optionally, a bottom surface of the counter bore portion adjacent to the main body portion is perpendicular to an axial direction of the main body portion.

Optionally, a bottom surface of the counter bore portion adjacent to the main body portion forms an angle, which is larger than 0 degree and is less than 90 degrees, with an axial direction of the outlet hole.

Preferably, the counter bore portion is integrated with the main body portion.

Optionally, the outlet hole includes a main body portion and a gasket. The filter element is mounted on the main body portion via the gasket, and an inner diameter of the gasket is larger than that of the main body portion.

A receiver for an automobile air conditioner includes a first receiver body, a filter element and a retaining plate for fixing the filter element. The first receiver body includes a second connecting hole and a first connecting hole for being connected with an external system. The filter element is provided in a passage of the second connecting hole in a way that the filter element covers the passage. A cross-sectional area of the second connecting hole at a position of the second connecting hole covered with the filter element is larger than flow areas of the second connecting hole at other positions thereof.

Preferably, the receiver further includes a limiting portion provided at a position of the second connecting hole arranged with the filter element. The limiting portion is located under the retaining plate to ensure a height of the position arranged with the filter element. The limiting portion is configured to prevent the retaining plate from inclining towards the filter element. Where being assembled, some of the retaining plates of the receivers in the prior art may incline towards the filter element, thereby compressing the filter element, which increases the flow resistance to the fluid in the flowing process and affects the uniformity of the product. According to the present application, by providing the limiting portion, even if the retaining plate inclines towards the filter element where being assembled, it will not press the filter element during the assembling process since it will not incline further after abutting against the limiting portion, therefore the filter element is still in the free state after being assembled, and thus the uniformity of the products is ensured. In this way, the flow resistance is reduced where the refrigerant flows through the filter element, and the supercooling degree at the high pressure end of the automobile air conditioner is sufficient, therefore the amount of the refrigerant filled in the automobile air conditioner system is reduced.

Optionally, the limiting portion is a limiting step or a limiting pole provided on the first receiver body, and the limiting step or the limiting pole is integrated with the first receiver body to facilitate the assembling process.

Optionally, the limiting portion is a limiting gasket provided on the first receiver body, and a height of the limiting gasket is equal to or larger than that of the filter element.

Preferably, the second connecting hole includes a second connecting hole main body portion for being connected and cooperated with an external system, and a counter bore adjacent to a cavity of the receiver. The counter bore portion includes a filter element accommodating portion provided between the retaining plate and the second connecting hole main body portion. The filter element is mounted at the filter element accommodating portion. A buffer space is formed between the filter element accommodating portion and the second connecting hole main body portion. And a flow area at an interface of the filter element accommodating portion and the buffer space is larger than a cross-sectional area of the second connecting hole main body portion.

Preferably, a height of the filter element accommodating portion is equal to or larger than that of the filter element, and a cross-sectional area of the filter element accommodating portion is larger than that of the buffer space and that of the second connecting hole main body portion.

Optionally, the counter bore portion is integrated with the second connecting hole main body portion, and a bottom surface of the counter bore portion adjacent to the second connecting hole main body portion is perpendicular to or forms an angle, which is larger than 0 degree and less than 90 degrees, with an axial direction of the second connecting hole main body portion.

Further, a ratio of a height H1 that a stopping surface of the retaining plate for stopping the filter element extends towards the second connecting hole to a height H2 from a step surface of the limiting step to an upper end surface of the first connecting hole, i.e., H1/H2, is within a range of 0.9-1.05.

It is also provided according to the present application a method for manufacturing a receiver for an automobile air conditioner. The receiver includes a first receiver body, a filter element and a retaining plate for fixing the filter element. The first receiver body includes a second connecting hole and a first connecting hole for being connected with an external system, and a filter element accommodating portion for accommodating the filter element. The receiver further includes a limiting portion configured to prevent the retaining plate from inclining towards the filter element. The filter element is provided in a passage of the second connecting hole in a way that the filter element covers the passage. A flow area of the second connecting hole at a position of the second connecting hole covered with the filter element is larger than cross-sectional areas of the second connecting hole at other positions thereof. A machining process of the receiver includes the following steps performed in sequence:

I. machining and cleaning the first receiver body. Preferably, the filter element accommodating portion and the limiting portion form an integral structure with the first receiver body; and the filter element accommodating portion and the limiting portion form the integral structure with the first receiver body during a cold extruding process of the first receiver body, or the integral structure is formed by a cold extruding process and a machining process performed sequentially;

II. mounting the filter element in the filter element accommodating portion;

III. mounting the retaining plate such that the retaining plate is mounted in place, preferably in a way that the retaining plate is stopped against the limiting portion and thus is fixed, or in a way that a gap is formed between the retaining plate and the limiting portion;

IV. pressing an end port portion of the retaining plate such that the end port portion of the retaining plate is abutted against an inner wall of a cavity of the first receiver body and thereby is fixed; and V. providing dots or an annular groove on the first receiver body after the end port portion of the retaining plate is pressed and expanded, such that the retaining plate is further limited and fixed. After the end port portion of the retaining plate is pressed and expanded, and the dots or the annular groove is provided on the first receiver body, the retaining plate will not incline towards the filter element because of the limiting action of the limiting portion, thereby the filter element will not be compressed.

Optionally, the step I of the machining process of the receiver may be replaced by the following steps:

I-1. machining and cleaning the first receiver body, and machining and cleaning a limiting gasket for forming a limiting portion; and I-2. mounting the limiting gasket in the first receiver body to form the limiting portion. A height of the limiting gasket is equal to or larger than that of the filter element.

The receiver for the heat exchanger according to the present application includes an inlet connecting hole and an outlet connecting hole. One of the connecting holes is covered with a filter element, and the flow area at the position of the connecting hole at a position of the connecting hole covered with the filter element is larger than cross-sectional areas of the connecting hole at other positions thereof. In this way, the filter area at the position of the connecting hole mounted with the filter element is increased without changing the other structures of the receiver, and thus the flow area of the refrigerant is increased, the flow resistance of the filter element to the refrigerant is reduced and the workload of the heat exchanger is decreased.

In a receiver for a heat exchanger according to a preferred embodiment of the present application, the surface of the counter bore portion mounted with the filter element includes a first arc segment and a second arc segment connected in a closed-loop manner. Compared with other shapes having the same flow area, this kind of shape including two segments has a larger circumference, and thus has a higher shock-resistance capability. Thereby the service life of the filter element is improved.

DETAILED DESCRIPTION OF THE INVENTION

The spirit of the present application is to provide a receiver used in a heat exchanger, for example, an automobile air conditioner. A filter element of the receiver has a small flow resistance to the refrigerant without changing the contour dimension of the receiver and the equivalent aperture of the filter element, which reduces the workload of the heat exchanger. Another spirit of the present application is to provide a heat exchanger having the receiver.

In order that those skilled in the art can better understand technical solutions of the present application, the present application will be further described in detail in conjunction with the accompanying drawings and embodiments.

Figure 1:
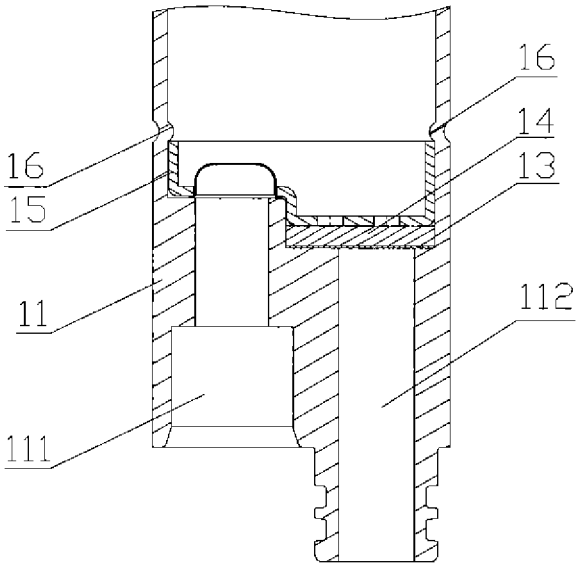
FIG. 1 is a structural schematic view of a typical receiver.
Figure 2:
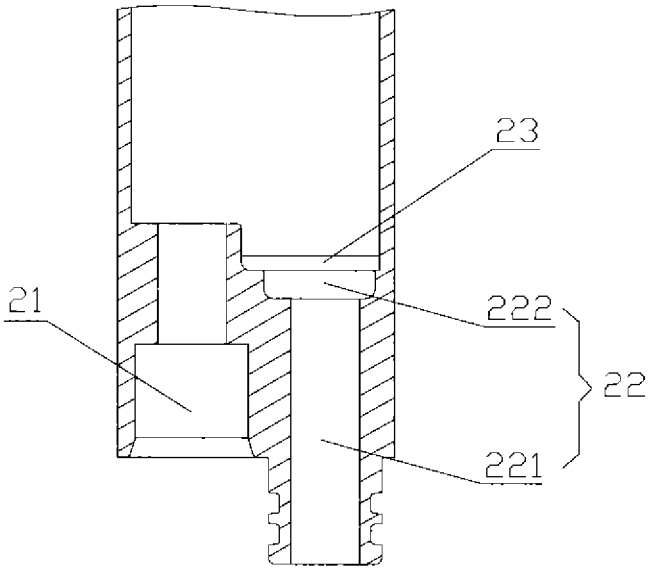
FIG. 2 is a structural schematic view of a receiver according to a first embodiment of the present application.

Reference is made to FIG. 2 which is a structural schematic view of an inlet portion and an outlet portion of a first receiver body of a receiver according to a first embodiment of the present application.

The receiver for a heat exchanger according to the present application includes the first receiver body and a second receiver body (not shown in the figure). The first receiver body of the receiver is provided with an inlet hole 21 and an outlet hole 22. A filter element 23 is provided at the outlet hole 22, with the outlet hole 22 being covered by the filter element 23, that is, the refrigerant flowing out of the outlet hole 22 is filtered by the filter element 23. A flow area of the outlet hole 22 at a position of the outlet hole 22 covered by the filter element 23 is larger than cross-sectional areas of at other positions of the outlet hole 22 at other positions thereof. During the operating process, the refrigerant in the heat exchanger flows into a cavity of the receiver through the inlet hole 21, and flows out of the outlet hole 22 after filtered by the filter element 23.

Generally, the filter element 23 covers an opening of the outlet hole 22, but the position that the filter element 23 is located is not limited to the openings of the hole, the filter element 23 may also be positioned at a certain cross section at a middle portion of the outlet hole 22. Thereby there is no restriction to the position of the filter element 23 in the outlet hole 22 as long as the refrigerant flowing out of the outlet hole 22 is filtered by the filter element 23.

In the present embodiment, the outlet hole 22 includes a main body portion 221 which is a segment close to an external of the inlet hole 21, and a counter bore portion 222 which is a segment close to an internal of the inlet hole 21. The filter element 23 is provided on the counter bore portion 222, and the surface area of the counter bore portion 222 at a position of the counter bore portion 222 covered with the filter element 23 is larger than the cross-sectional area of the main body portion 221. In this way, the filter element 23 is mounted by providing the counter bore portion 222 which has a cross-sectional area larger than that of the main body portion 221, which kind of structure is simplified and is easy to be manufactured.

Generally, the filter element 23 is mounted at the inner end surface of the counter bore portion 222 to facilitate the mounting thereof, however, without being limited to the inner end surface of the counter bore portion 222, the filter element 23 may also be mounted at the end surface of the counter bore portion 222 close to the main body portion 221, and so on, as long as the flow area of the counter bore portion 222 at a position thereof covered by the filter element 23 is larger than areas at other positions thereof.

It should be noted that the areas at other positions referred to herein are equal to original areas without being changed on the basis of the prior art.

The counter bore portion 222 is a straight bore, that is, the bottom surface of the counter bore portion 222 close to the main body portion 221 is perpendicular to the axial direction of the main body portion 221, and the sidewall of the counter bore portion 222 is vertical in the direction that the counter bore portion 222 extends. Since this kind of structure is of a straight bore configuration, it is easier to be manufactured and the production cost thereof is relatively low.

Figure 5:
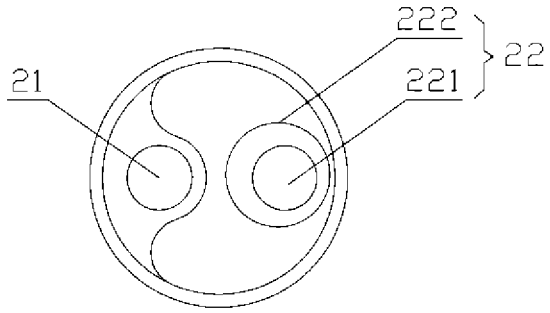
FIG. 5 is a structural schematic view showing a shape of an outlet hole of a receiver according to a first embodiment of the present application.
Figure 6:
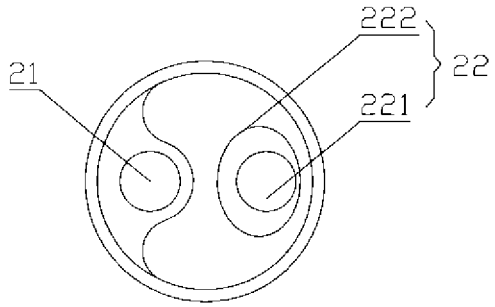
FIG. 6 is a structural schematic view showing a shape of an outlet hole of a receiver according to a second embodiment of the present application.
Figure 7:
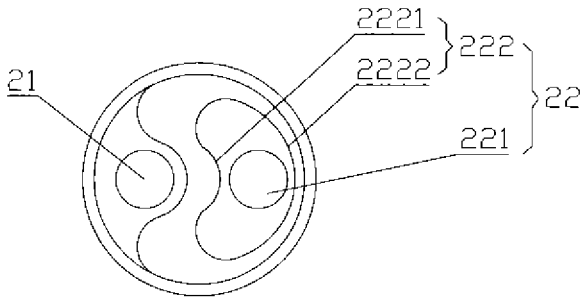
FIG. 7 is a structural schematic view showing a shape of an outlet hole of a receiver according to a third embodiment of the present application.

Reference is made to FIGS. 5, 6 and 7. FIG. 5 is a structural schematic view showing a shape of an outlet hole of a receiver according to a first embodiment of the present application, FIG. 6 is a structural schematic view showing a shape of an outlet hole of a receiver according to a second embodiment of the present application, and FIG. 7 is a structural schematic view showing a shape of an outlet hole of a receiver according to a third embodiment of the present application.

According to the first embodiment, the surface of the counter bore portion 222 covered with the filter element 23 may be of a circular shape. The circular structure is convenient to be manufactured and the manufacturing process thereof is simple. The diameter of the circular surface is determined according to the actual usage condition, which is not limited herein. Generally, the diameter of the circular surface is at least 1.3 times that of the main body portion 221 of the outlet hole 22.

According to the second embodiment, the surface of the counter bore portion 222 covered with the filter element 23 may be of an oval shape. The specific structure of the oval shape structure is determined according to the actual usage condition and is not limited herein.

According to the third embodiment, the surface of the counter bore portion 222 covered with the filter element 23 is of a shape including a first arc segment 2221 and a second arc segment 2222 connected in a closed-loop manner. In a case that several shapes have the same surface flow area, among which the shape including two segments has a larger circumference, and therefore has a higher shock resistance performance, thereby the service life of the filter element 23 is increased.

The above two arc segments may be connected in the closed-loop manner directly, and may also be smoothly connected via connecting arcs between the two arc segments.

Apparently, the counter bore portion 222 is not limited to include the first arc segment 2221 and the second arc segment 2222 only. In theory, the counter bore portion 222 may include more arc segments.

Without changing the inlet hole 21 and other structures of the receiver, the area at the outlet hole 22 mounted with the filter element 23 is increased and the filtering area is increased. Therefore the flow area of the refrigerant is increased and the flow resistance of the filter element 23 to the refrigerant is reduced, and therefore the workload of the heat exchanger is decreased.

Figure 3:
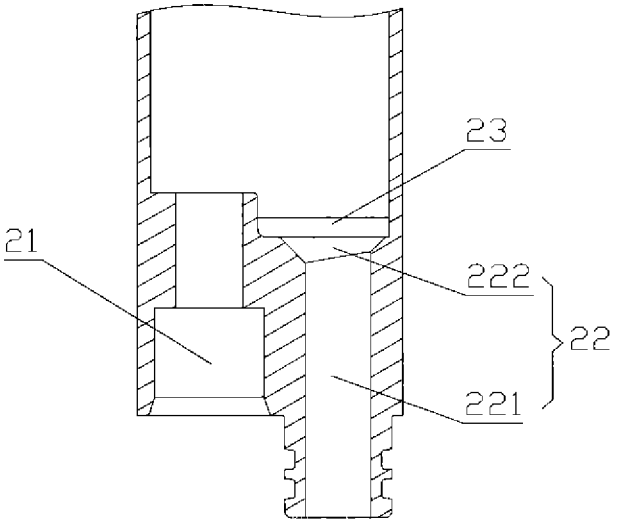
FIG. 3 is a structural schematic view of a receiver according to a second embodiment of the present application.

Reference is made to FIG. 3 which is a structural schematic view of a receiver according to a second embodiment of the present application.

According to the second embodiment, the bottom surface of the counter bore portion 222 adjacent to the main body portion 221 forms an angle, which is larger than 0 degree and less than 90 degrees, with the axial direction of the outlet hole 22, and the sidewall of the counter bore portion 222 forms a predetermined angle with the vertical plane in the direction that the counter bore portion 222 extends. Since the bottom surface of the counter bore portion 222 is inclined, the flow area is further increased with respect to a flat bottom surface, and thus the flow resistance is further reduced.

Generally, the above predetermined angle is about 30 degrees.

The counter bore portion 222 may be integrated with the main body portion 221, that is, the two portions may be formed by an integral molding such as the die stamping, and the two portions may also be formed by the die stamping and then by the machining process. Apparently, the counter bore portion 222 and the main body portion 221 are not limited to an integrated structure, they may be machined separately and then be fixedly connected by welding or other connecting manners.

Figure 4:
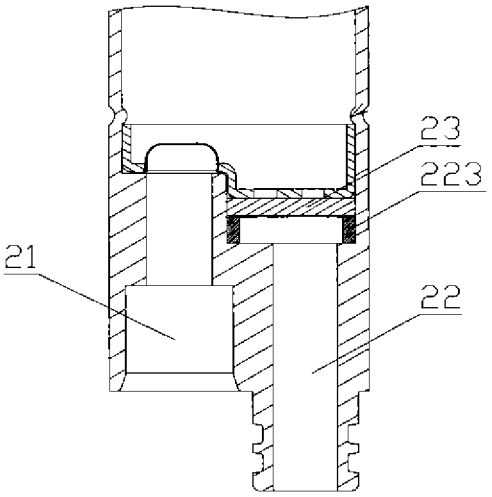
FIG. 4 is a structural schematic view of a receiver according to a third embodiment of the present application.

Reference is made to FIG. 4 which is a structural schematic view of a receiver according to a third embodiment of the present application.

According to the third embodiment, the outlet hole 22 includes a main body portion 221 and a gasket 223. The filter element 23 is mounted on the main body portion 221 via the gasket 223. The inner diameter of the gasket 223 is larger than that of the main body portion 221. The filter element 23 is mounted on the gasket 223, and a stopping mesh 15 is provided on the filter element 23 such that the filter element 23 is fixedly provided. According to the present embodiment, the filter element 23 is mounted via the gasket 223.

It should be noted that the above embodiments are only a part of the embodiments. In theory, any improvement made to the receiver may be an embodiment according to the present application as long as it can increase the filter area of the filter element 23 and decrease the flow resistance.

Further, in the above embodiments, the filter elements 23 are mounted in front of the outlet hole 22. In practice, the object of the present application may also be achieved by exchanging the inlet hole 21 and the outlet hole 22 in the above embodiments. That is, the fluid flows in through the hole 22 and is filtered by the filter element 23, and then flows, through the stop mesh 15, into the cavity of the receiver, and then flows out of the hole 21, thereby the object of the present application can be achieved. In a word, in the above two different arrangements, the hole 21 and the hole 22 can be summarized as a first passageway and a second passageway, wherein one of the first passageway and the second passageway acts as an inlet hole, and the remaining one of the first passageway and the second passageway acts as an outlet hole.

Figure 8:
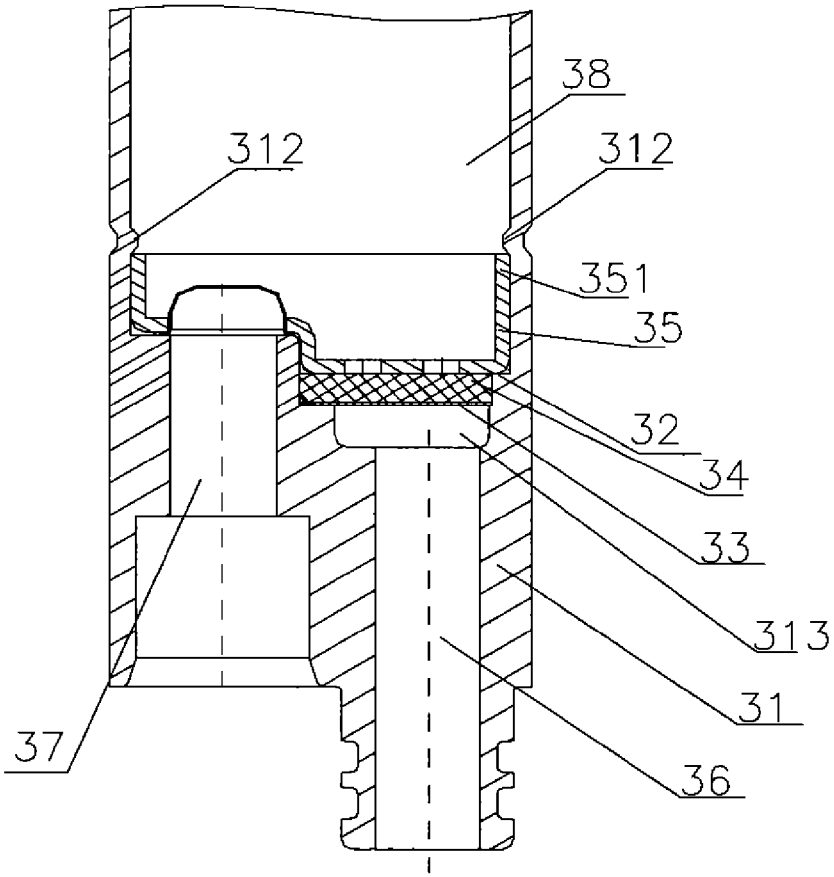
FIG. 8 is a partial sectional schematic view showing a structure of inlet and outlet portions of a receiver according to a fourth embodiment of the present application.
Figure 9:
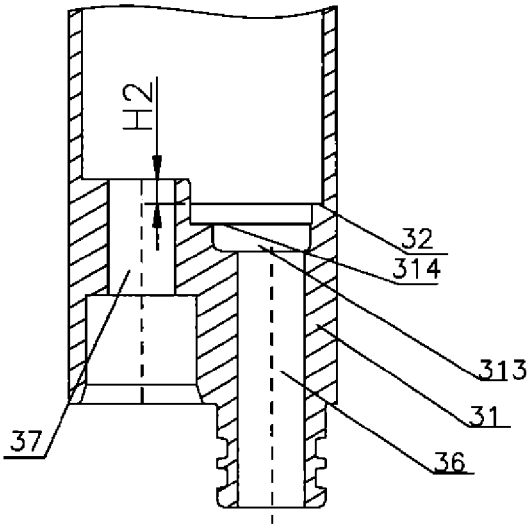
FIG. 9 is a partial sectional schematic view showing a structure of the first receiver body in the receiver shown in FIG. 8.
Figure 10:
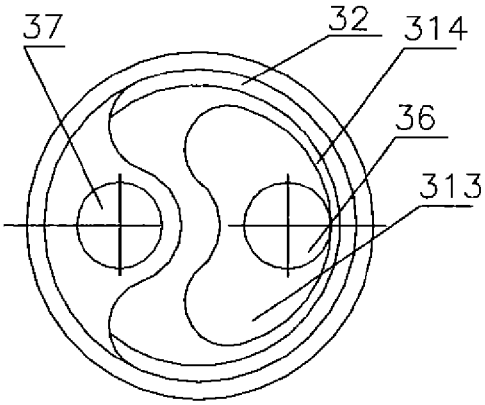
FIG. 10 is a top schematic view of the first receiver body in the receiver shown in FIG. 8.
Figure 11:
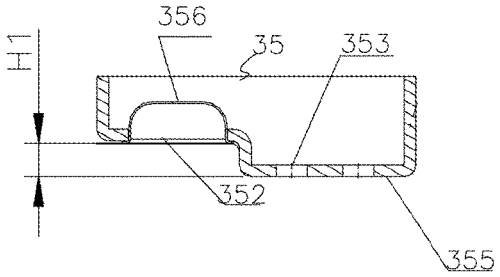
FIG. 11 is a sectional schematic view showing a structure of the retaining plate in the receiver shown in FIG. 8.

Another embodiment according to the present application is introduced hereinafter. As shown in FIGS. 8-11, FIG. 8 is a partial sectional schematic view showing a structure of inlet and outlet portions of a receiver according to a fourth embodiment of the present application. FIG. 9 is a partial sectional schematic view showing a structure of the first receiver body in the receiver shown in FIG. 8. FIG. 10 is a top schematic view of the first receiver body in the receiver shown in FIG. 8. FIG. 11 is a sectional schematic view showing a structure of the retaining plate in the receiver shown in FIG. 8.

The receiver includes a first receiver body 31 and a second receiver body (not shown in the figure). Since the present application mainly relates to improvements to the structure of the first receiver body portion, i.e., the inlet and the outlet portions of the receiver, only related portions are shown in the figures. A receiver cavity 38 is formed in the receiver. The receiver cavity 38 may be provided with molecular sieve desiccants, and may also be provided with other filter elements. The first receiver body is provided with a first connecting hole 37 and a second connecting hole. The first connecting hole 37 corresponds to the first passageway and the second connecting hole corresponds to the second passageway. The second connecting hole includes a second connecting hole main body portion 36 and a counter bore portion which is provided towards the inside of the cavity 38. The counter bore portion includes a buffer space 313 and a filter element accommodating portion 314. Further, a limiting portion, which is a limiting step 32 in the present embodiment, is provided on the filter element accommodating portion 314. In particular, the cross section of the buffer space 313 is a combined shape which is approximately of an annular shape, with two ends thereof being transited via arcs. Particularly, the buffer space 313 may include at least four arcs. The height of the buffer space 313 is larger than that of the filter element, thereby achieving a better effect where the buffer space 313 is covered by the filter element. More preferably, the height of the buffer space 313 is at least 1.7 times that of the filter element. In this way, the flow resistance to the fluid can be reduced more effectively. The filter element accommodating portion 314 has a shape matching that of the filter element. The height of the filter element accommodating portion 314 is equal to or larger than that of the filter element. In the present embodiment, the shape of the filter element accommodating portion 314 is combined by a plurality of arcs. The buffer space 313 is covered by the filter element accommodating portion 314. Similarly, the cross-sectional area of the filter element accommodating portion 314 is larger than that of the buffer space 313, and is also larger than that of the second connecting hole main body portion 36. That is, in the flow passage of the second connecting hole of the receiver, the flow area at the position covered by the filter element is larger than those at other positions of the second connecting hole, and the cross-sectional area at the interface of the buffer space 313 and the filter element accommodating portion 314 is larger than that of the second connecting hole main body portion. Besides, the buffer space 313 provided between the filter element and the second connecting hole main body 36 serves as a transition space. In this way, the filter area of the filter element is the cross-sectional area at the interface of the buffer space 313 and the filter element accommodating portion 314.

In order to fix the filter element, a retaining plate 35 is provided on the filter element. The structure of the retaining plate 35 is shown in FIG. 11. The retaining plate 35 is provided with a stopping surface 355, a group of second through holes 353 and a first through hole 352. The first through hole 352 is further provided with a first filter screen 356. The filter screen 356 is fixedly provided on the retaining plate 35, for example, the filter screen 356 is fixedly provided on the retaining plate 35 by welding, such as spot welding or pressure welding. The stopping surface 355 is configured to restrict the filter element so as to prevent the filter element from dropping out of the filter element accommodating portion 314.

Further, in order to ensure that the filter element is not deformed due to compression after being placed at the filter element accommodating portion 314, to thereby ensure the filtering performance thereof, in the present embodiment, a limiting portion is further provided on the filter element accommodating portion 314. Particularly, the limiting portion is configured as a limiting step 32 which is of a continuous semi-annular shape. Alternatively, the limiting step 32 may also be of a discontinuous annular shape. In the present embodiment, the limiting step 32 which functions as the limiting portion and the first receiver body are formed into one piece, for example, by stamping, or by stamping and subsequent finish machining. In the present embodiment, the filter element includes a filter 34 and a second metal filter screen 33. Particularly, the filter 34 may be a non-woven fabric. The height H1 of the stopping surface 355 of the retaining plate 35 with respect to the base surface of the retaining plate 35, that is, the height H1 that the stopping surface of the retaining plate for stopping the filter element extends towards the second connecting hole, is substantially equal to the height H2 from the step surface of the limiting step to the upper end surface of the first connecting hole. In particular, the ratio of the height H1 of the stopping surface 355 with respect to the base surface of the retaining plate 35 to the height H2 from the step surface of the limiting step to the upper end surface of the first connecting hole, i.e., H1/H2, is within a range of 0.90-1.05.

In the present embodiment, where assembling the receiver, the filter element is mounted in the first receiver body which has been machined, and then the retaining plate is mounted in the first receiver body such that the retaining plate, after being in place, abuts against the limiting portion and thus is fixedly mounted. It is possible that there is a gap between the retaining plate and the limiting portion after the retaining plate is in place, at this time, the end port portion 351 of the retaining plate 35 which faces the cavity is pressed and expanded, such that the end port portion 351 of the retaining plate 35 abuts against the inner wall of the cavity of the first receiver body and therefore is fixedly mounted, thereby preventing the fluid from flowing through the gap between the end port portion 351 of the retaining plate 35 and the inner wall of the first receiver body or reducing the amount of the fluid that flows through the gap, and preventing the retaining plate from rotating. After the retaining plate is fixed, in order to further ensure the position of the retaining plate, dots or an annular groove is provided on the first receiver body such that the axial position of the retaining plate 35 is limited and fixed. As shown in FIG. 8, three inwardly protruded dots 312 are provided on the wall of the first receiver body to limit the position of the retaining plate 35. In this way, the axial and radial positions of the retaining plate 35 are limited, and the height of the filter element accommodating portion is fixed by providing a limiting portion above the filter element accommodating portion of the first receiver body. After the retaining plate 35 is mounted, the height from the stopping surface 355 of the retaining plate 35 to the interface of the buffer space 313 and the filter element accommodating portion 314 is equal to or larger than the height of the filter element. In this way, the filter element is not compressed and therefore the originally free state thereof is maintained.

Figure 12:
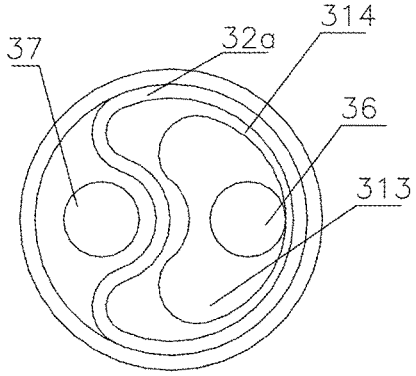
FIG. 12 is a top schematic view of a first receiver body portion of a receiver according to a fifth embodiment of the present application.

As an improvement to the fourth embodiment mentioned above, a fifth embodiment is introduced below. FIG. 12 is a top schematic view of a first receiver body portion of a receiver according to a fifth embodiment of the present application. As shown in the figure, the main difference between the present embodiment and the fourth embodiment lies in that the structures of the limiting portion are different. In the present embodiment, the limiting step 32*a* functioning as a limiting portion is a closed-loop structure formed by multiple arc segments. Similarly, the limiting step 32*a* may be formed integrally with the main body by stamping. Other structures in the present embodiment are the same as those in the fourth embodiment, and thus description thereof is omitted herein.

Figure 13:
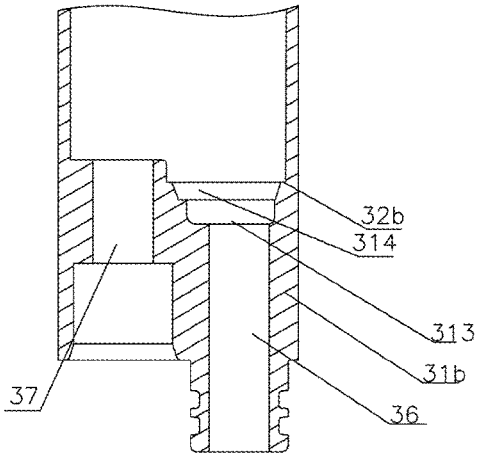
FIG. 13 is a partial structural schematic view of a first receiver body portion of a receiver according to a sixth embodiment of the present application.
Figure 14:
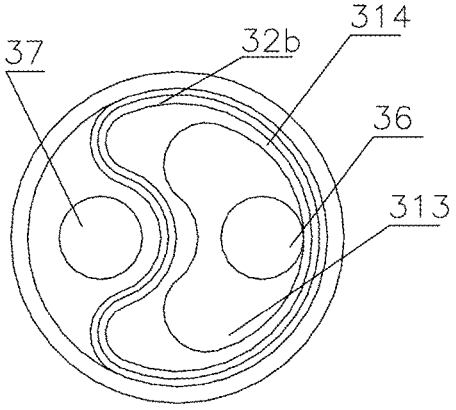
FIG. 14 is a top view of the first receiver body shown in FIG. 13.

Another embodiment according to the present application is introduced below. FIG. 13 is a partial structural schematic view of a first receiver body portion of a receiver according to a sixth embodiment of the present application. FIG. 14 is a top view of the first receiver body shown in FIG. 13. The main difference between the present embodiment and the fifth embodiment lies in that the structures of the filter element accommodating portion are different. In the present embodiment, the filter element accommodating portion 314 is an inclined step structure, and is formed integrally with the first receiver body 31*b*. The limiting step functioning as a limiting portion is an inclined step 32*b*. The inclined step 32*b*, the filter element accommodating portion 314 and the buffer space 313 are all formed integrally with the first receiver body. This kind of arrangement has advantages, for example, in a case that the first receiver body is formed by a cold extruding, the above arrangement can facilitate the flow of the metal and thus the flow molding, can improve the unevenness of the wall thickness of the first receiver body, thereby the uniformity of the products is ensured and the production qualified rate is improved. Other structures in the present embodiment are the same as those in the above embodiments, and thus description thereof is omitted herein.

Figure 15:
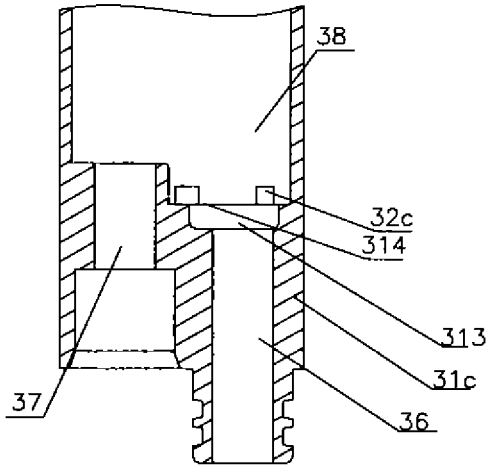
FIG. 15 is a partial structural schematic view of a first receiver body portion of a receiver according to a seventh embodiment of the present application.
Figure 16:
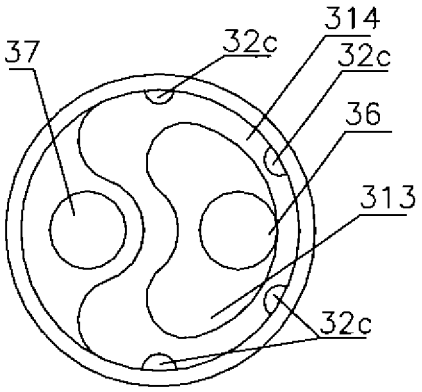
FIG. 16 is a top view of the first receiver body shown in FIG. 15.

Another embodiment according to the present application is introduced below. FIG. 15 is a partial structural schematic view of a first receiver body portion of a receiver according to a seventh embodiment of the present application. FIG. 16 is a top view of the first receiver body shown in FIG. 15. The main difference between the present embodiment and the fifth embodiment lies in that the structures of the limiting portion, the filter element accommodating portion and the filter element are different. In the present embodiment, the first receiver body 31*c* is provided with at least two limiting poles 32*c*. The limiting poles 32*c* form the limiting portion of the receiver. The limiting poles 32*c* extend from the bottom portion of the buffer space 313 to the top portion of the filter element accommodating portion 314, in particular, top surfaces of the limiting poles 32*c* form the top portion of the filter element accommodating portion. Where the retaining plate 35 is placed in the first receiver body, the retaining plate 35 abuts on the top surfaces of the limiting poles and is positioned. Accordingly, the filter element will not be compressed by the retaining plate 35 due to the inclination of the retaining plate 35 where the retaining plate 35 is pressed and expanded, and thus the uniformity of the product can be ensured. Accordingly, the filter element accommodating portion 314 has corresponding notched portions. Correspondingly, the shape of the filter element 35 matches that of the filter element accommodating portion 314.

Figure 17:
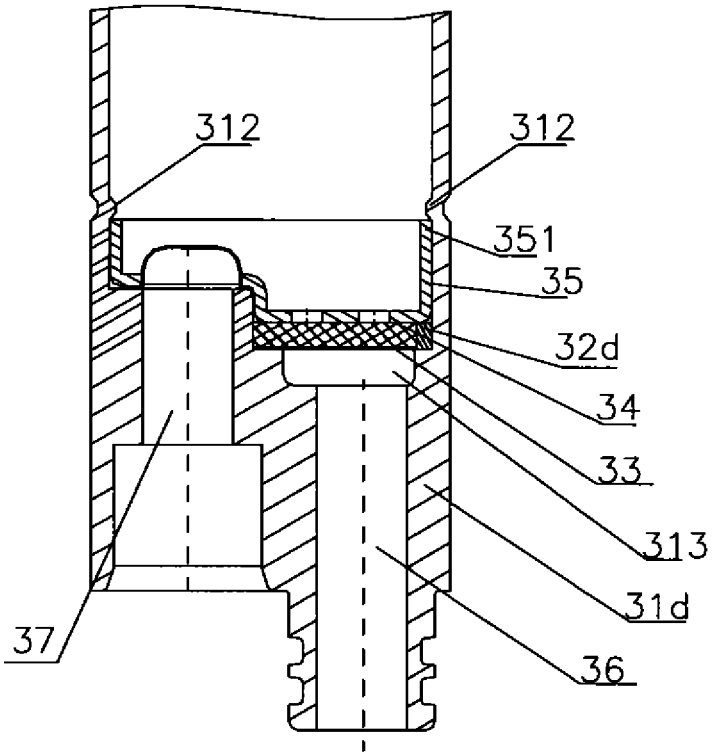
FIG. 17 is a partial sectional schematic view showing a structure of inlet and outlet portions of a receiver according to an eighth embodiment of the present application.
Figure 18:
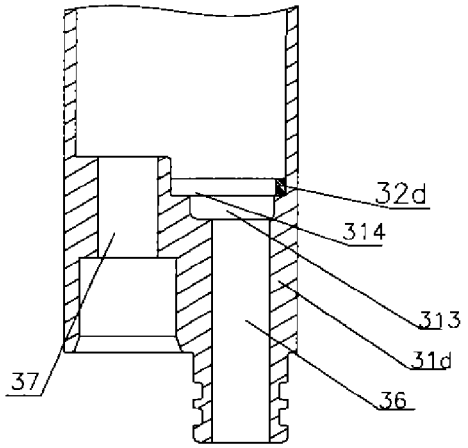
FIG. 18 is a partial sectional schematic view showing a structure of the first receiver body of the receiver shown in FIG. 17 after fitted with a limiting gasket.
Figure 19:
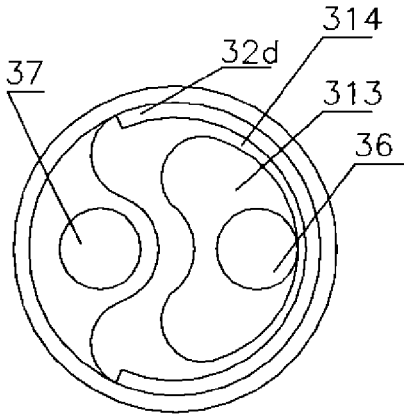
FIG. 19 is a top view of FIG. 18.

In the above embodiments, the limiting portions are formed integrally with the first receiver body. The present application is not limited to the above arrangements. The limiting portion may be assembled to the first receiver body. As shown in FIGS. 17, 18 and 19, FIG. 17 is a partial sectional schematic view showing a structure of inlet and outlet portions of a receiver according to an eighth embodiment of the present application, FIG. 18 is a partial sectional schematic view showing a structure of the first receiver body of the receiver shown in FIG. 17 after fitted with a limiting gasket, and FIG. 19 is a top view of FIG. 18. In the present embodiment, the first receiver body 31*d* is provided with a first connecting hole 37 and a second connecting hole. The first receiver body 31*d* is further provided, at the inner side of the main body portion of the second connecting hole facing the cavity, with a buffer space 313 and a filter element accommodating portion 314. Particularly, the buffer space 313 has a combined shape which is approximately of an annular shape, with two ends thereof being transited via arcs. In particular, the buffer space 313 may include at least four arcs. The height of the buffer space 313 is larger than that of the filter element, thereby achieving a better effect where the buffer space is covered by the filter element. More preferably, the height of the buffer space 313 is at least 1.7 times that of the filter element. In the present embodiment, the limiting portion is achieved by providing a limiting gasket 32*d* at the filter element accommodating portion 314. In particular, the limiting gasket 32*d* is substantially a semi-annular gasket. Alternatively, the limiting gasket 32*d* may also be a closed-loop structure corresponding to the spatial shape. The filter element accommodating portion 314 is the space at which the limiting gasket 32*d* is placed except for the limiting gasket 32*d*. Accordingly, the filter element has a shape corresponding to that of the filter element accommodating portion 314. Besides, the height of the limiting gasket 32*d* is equal to or larger than that of the filter element, therefore the height of the filter element accommodating portion 314 is equal to or larger than that of the filter element. Alternatively, the limiting gasket may also be provided on the filter element, with a portion of the periphery of the filter element deformed because of being compressed while the filter portion at a middle portion thereof remained in the free state, such that the filter performance and flow resistance thereof are not affected.

In the present embodiment, the shape of the filter element accommodating portion 314 includes a plurality of arcs and straight lines. The buffer space 313 is covered by the filter element accommodating portion 314. Similarly, the cross-sectional area of the filter element accommodating portion 314 is larger than that of the buffer space 313, and is larger than that of the second connecting hole main body portion 36. That is, in the passage of the second connecting hole of the receiver, the flow area at the position covered by the filter element is larger than cross-sectional areas at other positions of the second connecting hole. The cross-sectional area at the interface of the buffer space 313 and the filter element accommodating portion 314 is larger than that of the second connecting hole main body portion. The buffer space 313 functions as a transition space between the filter element and the second connecting hole main body portion, and the flow area of the buffer space 313 is larger than that of the second connecting hole main body portion, in this way, the filter area of the filter element is the cross-sectional area at the interface of the buffer space 313 and the filter element accommodating portion 314. In the present embodiment, the gasket may include several gasket segments, for example, two segments. The material of the gasket may be metal or plastic. This kind of arrangement has advantages, for example, the height of the filter element accommodating portion 314 is relatively flexible, and may be adjusted according to actual requirements. Besides, there is no need to modify the extrusion die of the first receiver body. In cases where different filter elements are required, there is no need to modify the first receiver body and other dies and tools, while it only needs to modify the limiting gasket 32*d* and the retaining plate 35, which can improve the standardization of the production, and thus can save the manufacturing cost.

In the present embodiment, the filter element includes a filter 34 adjacent to the retaining plate 35 and a second metal filter screen 33 adjacent to the buffer space 313. The filter element may also be configured in such a way that the filter 34 is provided between two metal filter screens, which is not limited to the embodiments described herein.

In the present embodiment, where assembling the receiver, the limiting gasket 32*d* is firstly mounted in the first receiver body which has been machined, then is the filter element, and then is the retaining plate 35, such that the retaining plate 35, after being in place, abuts against the limiting portion and thus is fixedly mounted. Then the end port portion 351 of the retaining plate 35 facing the cavity is pressed and expanded such that the end port portion 351 of the retaining plate 35 abuts against the inner wall of the cavity of the first receiver body, thereby preventing the fluid from flowing through the gap between the end port portion 351 of the retaining plate 35 and the inner wall of the first receiver body or reducing the amount of the fluid that flows through the gap, and preventing the retaining plate 35 from rotating circumferentially. After the retaining plate 35 is fixed, dots are provided on the first receiver body to form inwardly protruded dots, or an annular groove is provided on the first receiver body to form an inwardly protruded annular line, such that the first receiver body is deformed at the position provided with the inwardly protruded dots or the inwardly protruded annular line to further limit and fix the retaining plate 35. In this way, the axial position of the retaining plate 35 is further fixed. As shown in FIG. 8, three inwardly protruded dots 312 are provided on the wall of the first receiver body to limit and fix the retaining plate 35. Therefore, the axial and radial positions of the retaining plate 35 are limited and fixed, and the height of the filter element accommodating portion is ensured by providing the limiting gasket 32*d* in the first receiver body. Even if the end port portion 351 of the retaining plate 35 is pressed and expanded after the retaining plate 35 is mounted, and even if the retaining plate 35 is slightly deformed where providing the dots or the annular groove on the first receiver body, the height of the filter element accommodating portion can still be ensured by virtue of the limiting portion. Besides, the height from the stopping surface 355 of the retaining plate 35 of the filter element accommodating portion to the interface of the buffer space 313 and the filter element accommodating portion 314 is equal to or larger than that of the filter element. In this way, the filter element can maintain its original free state and thus will not be compressed.

Figure 20:
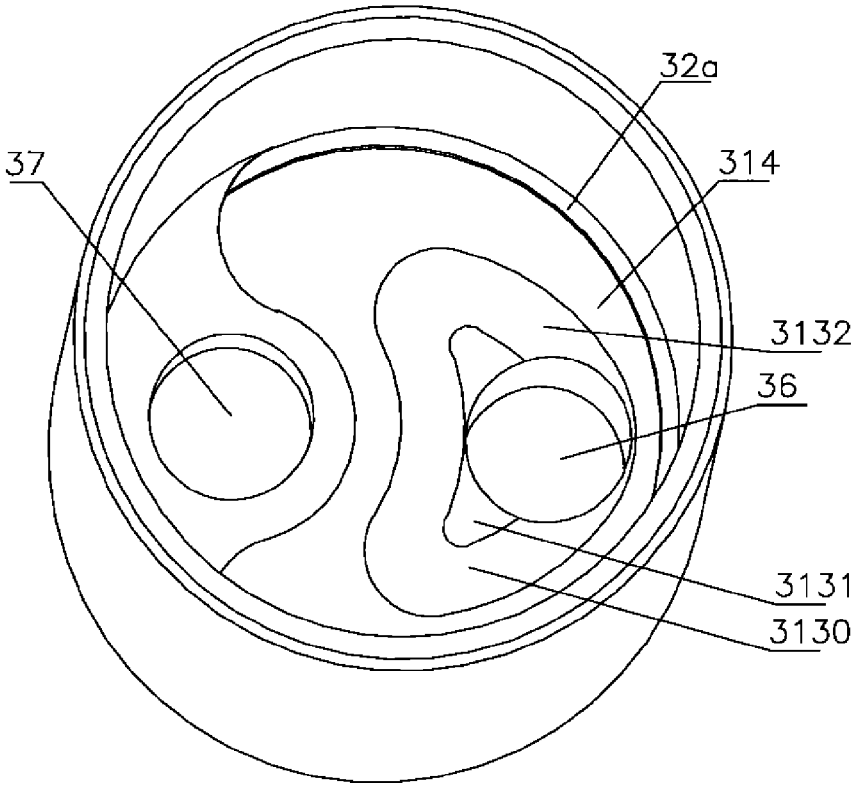
FIG. 20 is a partial top perspective schematic view showing inlet and outlet portions of a first receiver body of a receiver according to a ninth embodiment of the present application after being exploded.

Yet another embodiment of the present application is introduced below. FIG. 20 is a partial top perspective schematic view showing inlet and outlet portions of a first receiver body of a receiver according to a ninth embodiment of the present application after being exploded. The present embodiment makes improvements to the fourth embodiment described above, the main difference therebetween lies in that, in the present embodiment, the interface 3132 of the buffer space 3130 and the filter element accommodating portion is larger than the bottom surface 3131 of the buffer space. The shapes of the interface 3132 and the bottom surface 3131 may be various and they are not limited herein. In this way, on one hand, the receiver has a relatively large filter element interface, therefore the filter capacity is relatively high and the flow resistance can be reduced. On the other hand, this kind of structure can facilitate the flow of the metal during the cold extruding process and thus the flow molding, can improve the unevenness of the wall thickness of the first receiver body, thereby the forming process is easier and the uniformity of the product is improved. Other structures in the present embodiment are the same as those in the fourth embodiment, and thus description thereof is omitted herein.

In addition, a counter bore formed by cold extruding is provided in the above embodiments. The present application is not limited to the above embodiments. Alternatively, the counter bore may be formed by machining, for example, by machining one end of the second connecting hole facing the cavity of the receiver into a tapered hole with the inner end thereof having a relatively large diameter, such that the interface of the upper portion of the second connecting hole and the filter element accommodating portion has a large cross-sectional area. In this way, the filter area of the filter element can also be increased, and a transition buffer space can also be formed. Alternatively, the counter bore may be formed by providing a gasket.

In the above embodiments, the first connecting hole 37 may serve as an inlet hole of the receiver, then the second connecting hole main body portion 36 serves as an outlet hole of the receiver. In use, the fluid flows in through the first connecting hole 37, and then flows into the cavity 38 of the receiver after being filtered by the first filter screen 356 of the retaining plate 35. Then the fluid flows through the second through holes 353 and is filtered by the filter element, and then flows into the buffer space 313, and lastly flows out through the second connecting hole main body portion 36. Alternatively, the first connecting hole 37 may also serve as an outlet hole of the receiver, then the second connecting hole main body portion 36 serves as an inlet hole of the receiver. That is, the fluid flows into the buffer space 313 through the second connecting hole main body portion 36, then flows into the cavity 38 of the receiver through the filter element and the second through holes 353 of the retaining plate in sequence, and ultimately flows out through the first connecting hole 37 after being filtered by the first filter screen 356 of the retaining plate 35. That is, according to the present application, by providing a limiting portion at the inner end of the through hole in the first receiver body of the receiver, the retaining plate 35 will not incline towards the filter element after mounted, thereby the non-woven fabric filter of the filter element is protected from being compressed, the flow resistance is reduced, and the load of the automobile air conditioner is reduced. Also, by providing the buffer space 313 at the position of the passage covered with the filter element and increasing the flow area at the position of the passage covered with the filter element, the filter area is increased, and thus the flow resistance is reduced, and the load of the automobile air conditioner is reduced.

The heat exchanger and the receiver thereof according to the present application are described in detail in the above description. The expressions, such as upper, lower, inner, outer, front, back, and so on, referred to in the above description are only for ease of description, and should not be construed as limitations to the protection scope of the present application. The principle and embodiments of the present application are explained by way of examples. The description of the above embodiments is only used for the understanding of the method and the spirit of the present application. It should be noted that, those skilled in the art may make many improvements and modifications to the present application without departing from the principle of the present application, and these improvements and modifications also fall into the protection scope of the claims of the present application.

What is claimed is:

1. A receiver for a heat exchanger comprising:

a first receiver body defining a first passageway and a second passageway in condition that one of the first passageway and the second passageway acts as an inlet hole, and the remaining one of the first passageway and the second passageway acts as an outlet hole, the second passageway comprising a main body portion and a buffer space in communication with the main body portion; and a filter element covering the buffer space so as to filter the second passageway; wherein the buffer space is empty and comprises a first end opening directly covered by the filter element and a second end opening in communication with the main body portion; and wherein an area encircled by the first end opening of the buffer space is larger than a horizontal cross-sectional area of the main body portion adjacent to the buffer space, as a result that a relatively large filter interface can be achieved; and wherein the second passageway comprises a counter bore portion, the counter bore portion comprising the buffer space, an accommodating hole above and in communication with the buffer space and a positioning hole above and in communication with the accommodating hole, the filter element being received in the accommodating hole, the receiver further comprising a retaining plate at least partly received in the positioning hole, the buffer space being provided with a reasonable large thickness so as to perform a buffering function when a refrigerant flows through the second passageway.

2. The receiver for the heat exchanger according to claim 1, wherein the buffer space is tapered with the first end opening larger than the second end opening, the first end opening and the second end opening being positioned at a top side and a bottom side of the buffer space, respectively.

3. The receiver for the heat exchanger according to claim 2, wherein a separating surface of the buffer space and the main body portion is inclined with respect to a horizontal plane for guiding flowing of a refrigerant.

4. The receiver for the heat exchanger according to claim 1, further comprising a gasket residing in the buffer space to upwardly support the filter element, a height of the gasket determining the thickness of the buffer space.

5. The receiver for the heat exchanger according to claim 1, wherein the retaining plate is fixed in an inner cavity of the receiver for restricting the filter element, the retaining plate comprising a bottom wall which has a top platform and a bottom platform arranged in a stepped manner, the top platform comprising a first through hole in communication with the first passageway and a first filter screen filtering the first through hole, the filter element comprising a second filter screen covering the first end opening of the buffer space, the bottom platform defining a plurality of second through holes above the second filter screen.

6. The receiver for the heat exchanger according to claim 5, wherein the filter element comprises a non-woven fabric filter sandwiched between the second filter screen and the bottom platform, the bottom platform of the retaining plate being received in the positioning hole, the first filter screen protruding upwardly into the inner cavity, the filter element being pressed and/or restricted by the bottom platform of the retaining plate so as to be prevented from dropping out of the receiver.

7. The receiver for the heat exchanger according to claim 5, wherein the accommodating hole is larger than the buffer space so as to form a first step surface therebetween to stop/position the filter element, and the positioning hole is larger than the accommodating hole so as to form a second step surface therebetween to stop/position the bottom platform of the retaining plate.

8. The receiver for the heat exchanger according to claim 7, wherein a height of the filter element is smaller than or equal to a depth of the accommodating hole so that the filter element can be prevented from being over-compressed by the bottom platform of the retaining plate.

9. The receiver for the heat exchanger according to claim 5, further comprising a limiting member protruding upwardly beyond the buffer space to support the bottom platform of the retaining plate, the limiting member being either a plurality of protruding limiting poles discontinuously distributed outside of the buffer space or a semi-annular limiting gasket located outside of the buffer space.

10. The receiver for the heat exchanger according to claim 9, wherein the limiting member is ultimately integral with the first receiver body either the limiting member and the first receiver body are originally integral with each other, or the limiting member and the first receiver body are separated before assembling while being integral with each other after assembling and processing.

11. The receiver for the heat exchanger according to claim 10, wherein a top surface of the limiting member is higher than or equal to a top surface of the filter element so that when the retaining plate is assembled in place, the top surface of the limiting member supports the bottom platform of the retaining plate so as to prevent the filter element from being over-compressed by the bottom platform of the retaining plate.

12. A receiver for a heat exchanger comprising:

a first receiver body defining a first passageway and a second passageway in condition that one of the first passageway and the second passageway acts as an inlet hole and the remaining one of the first passageway and the second passageway acts as an outlet hole;

a filter element received in the second passageway and filtering the second passageway;

a retaining plate received and fixed in the first receiver body for restricting the filter element; and a limiting member residing in the second passageway and located below the retaining plate; wherein the limiting member upwardly support the retaining plate so that the filter element can be prevented from being compressed or over-compressed by the retaining plate;

wherein the first receiver body comprises an embossment through which the first passageway extends, the second passageway comprising a main body portion and a counter bore portion located at lateral side of the embossment, the limiting member residing in the counter bore portion, the filter element being received in the counter bore portion, the retaining plate comprising a bottom wall which comprises a top platform and a bottom platform arranged in a stepped manner, the top platform being supported and restricted by the embossment, the bottom platform being supported by the limiting member; and under the cooperation of the embossment and the limiting member, the bottom wall of the retaining plate is horizontally positioned in place without inclination, and thus the filter element can be prevented from being compressed or over-compressed by the bottom platform of the retaining plate; and wherein the counter bore portion is separated out by the filter element to form a buffer space under the filter element, the buffer space being empty and comprising a first end opening directly covered by the filter element and a second end opening in communication with the main body portion, the buffer space being provided with a reasonable large thickness between the first end opening and the second end opening so as to perform a buffering function when a refrigerant flows through the second passageway.

13. The receiver for the heat exchanger according to claim 12, wherein the limiting member is a step surface formed on the first receiver body, or a plurality of protruding limiting poles distributed at the peripheral of the filter element, or a limiting gasket at least partly surrounding the filter element.

14. The receiver for the heat exchanger according to claim 13, wherein the limiting member is ultimately integral with the first receiver body either the limiting member and the first receiver body are originally integral with each other, or the limiting member and the first receiver body are separated before assembling while being integral with each other after assembling and processing.

15. The receiver for the heat exchanger according to claim 12, wherein the buffer space is tapered with the first end opening larger than the second end opening, the first end opening and the second end opening being positioned at a top side and a bottom side of the buffer space, respectively.

* * * * *